US010648760B2

(12) United States Patent
Gold et al.

(10) Patent No.: US 10,648,760 B2
(45) Date of Patent: May 12, 2020

(54) ADJUSTABLE GRIP INSERT

(71) Applicant: Hoyt Archery, Inc., Salt Lake City, UT (US)

(72) Inventors: Brian Gold, Stansbury Park, UT (US); Zak T. Kurtzhals, Herriman, UT (US)

(73) Assignee: HOYT ARCHERY, INC., Salt Lake City, UT (US)

( * ) Notice: Subject to any disclaimer, the term of this patent is extended or adjusted under 35 U.S.C. 154(b) by 43 days.

(21) Appl. No.: 14/488,506

(22) Filed: Sep. 17, 2014

(65) Prior Publication Data

US 2016/0076849 A1 Mar. 17, 2016

(51) Int. Cl.
*F41B 5/14* (2006.01)
*F41B 5/10* (2006.01)

(52) U.S. Cl.
CPC ..... *F41B 5/1403* (2013.01); *F41B 5/10* (2013.01)

(58) Field of Classification Search
CPC ..... F41B 5/10; F41B 5/1403; F41B 5/148
See application file for complete search history.

(56) References Cited

U.S. PATENT DOCUMENTS 2,163,503 A * 6/1939 Tate ..... F41G 1/467 124/23.1
3,407,799 A * 10/1968 Reynolds ..... F41B 5/0005 123/47 R
3,415,241 A * 12/1968 Bear ..... F41B 5/0031 124/23.1
3,538,902 A * 11/1970 Fowkes ..... F41B 5/0031 124/23.1
4,175,536 A * 11/1979 Carella ..... F41B 5/14 124/23.1
5,194,677 A * 3/1993 Schuemann ..... F41A 17/22 42/7
5,241,945 A * 9/1993 Shepley, Jr. ..... F41B 5/0031 124/23.1
5,551,413 A 9/1996 Walk
5,615,663 A * 4/1997 Simonds ..... F41B 5/0031 124/23.1

(Continued)

OTHER PUBLICATIONS

High Demand Archery Pro Slim Grip, Lancaster Archery Supply, Item #7800002, http://lancasterarchery.com/high-demand-archery-pro-slim-grip.html.

*Primary Examiner* — Melba Bumgarner
*Assistant Examiner* — Amir A Klayman
(74) *Attorney, Agent, or Firm* — Dorsey & Whitney LLP

(57) ABSTRACT

An archery bow is shown that has a modular hand grip. The bow may include a riser having an upper end, a lower end, and a grip attachment portion disposed between the upper and lower ends. The grip attachment portion may be positioned to be held by a hand of an archer and may have an opening receiving a grip insert. The grip insert may have a contoured surface configured to contact the hand of the archer and may have a protrusion configured to be received by the opening. The bow may also have upper and lower limbs each having proximal ends connected to respective ends of the riser and each having distal ends. A bowstring may extend between the distal ends of the upper and lower limbs. The modular hand grips may improve shot consistency and feel, reduce torque, and still allow the bow to be customized.

17 Claims, 5 Drawing Sheets

(56) References Cited

U.S. PATENT DOCUMENTS

| | | | | |
|---|---|---|---|---|
| 5,842,460 | A * | 12/1998 | Barber | F41B 5/14 124/88 |
| 6,662,798 | B1 * | 12/2003 | Johnson | F41B 5/0031 124/88 |
| 6,988,495 | B1 * | 1/2006 | Van Hoorn | F41B 5/14 124/88 |
| 2007/0193571 | A1 * | 8/2007 | Moss | F41B 5/14 124/88 |
| 2010/0154279 | A1 * | 6/2010 | Polyzos | F41C 23/10 42/117 |
| 2011/0132344 | A1 * | 6/2011 | Moon | F41B 5/14 124/88 |
| 2015/0211825 | A1 * | 7/2015 | Chang | F41B 5/1403 124/23.1 |

* cited by examiner

ADJUSTABLE GRIP INSERT

TECHNICAL FIELD

The present disclosure generally relates to hand grips for archery bows and specifically relates to adjustable hand grip inserts for archery bows.

BACKGROUND

Archery bows are carefully tuned for optimal weight, size, torque, dampening, and other mechanical characteristics. Skilled archers take advantage of finely controlling the forces and moments induced in the bow as an arrow is launched in order to improve comfort and consistency.

The hand grip is one part of the bow that can affect its feel and the forces at work on the bow, arrow, and archer. If an archer grips a bow too tightly, tension in the archer's bow hand or arm may cause the bow to rotate when the bowstring is released. A thick or sticky grip increases hand-to-bow contact which increases the chance that the archer's hand will torque the riser during the shot and create inconsistency during shooting, negatively impacting accuracy. Some archers take lengths to avoid these problems, even to the extent of removing a grip entirely, but this decreases comfort, dampening, and insulation of the riser and is not usually a desirable option.

Conventional hand grips have either been integrated with the riser or have been modularly attachable by sliding over and fastening to the outer surface of the handle riser. An integrated hand grip provides stability and rigidity to the bow, but it also limits the archer's ability to customize or change the grip for a desired draw length, grip angle, or grip size. This means that the archer has less control over the bow if it is not designed with his or her hand in mind.

Attachable grips that slide over a portion of the riser are limited by shape and size due to the stress and flex characteristics of the riser design. As material is removed to allow alignment and attachment of the grip parts, the flex and material stresses in the riser are increased and can have a negative impact on the overall shooting experience of the bow. Attachable grips also typically produce a larger and wider grip which provides a wider base for hand contact and can therefore increase the grip pressure and torque applied to the bow by the hand. This increased torque can cause poor tuning and arrow flight as well as inconsistent accuracy. Therefore, there is a need for improvements in existing bow hand grips.

SUMMARY

According to an aspect of the present disclosure, an archery bow may be provided that has a modular hand grip. The bow may comprise a riser having an upper end, a lower end, and a grip attachment portion disposed between the upper and lower ends. The grip attachment portion may be positioned to be held by a hand of an archer, wherein the grip attachment portion may have an opening receiving a grip insert. The grip insert may have a contoured surface configured to contact the hand of the archer and may have a protrusion configured to be received by the opening of the grip attachment portion. The bow may also have upper and lower limbs each having proximal ends connected to respective ends of the riser and each having distal ends. A bowstring may extend between the distal ends of the upper and lower limbs.

The opening in the grip attachment portion may comprise an elongated slot and the grip insert may comprise an elongated protrusion attachable in the slot. The grip insert may be removably attachable to the grip attachment portion. In some cases, a position of the grip insert relative to the grip attachment portion may be adjustable. For example, a position of a front surface of the grip insert may be adjustable relative to a rear surface of the grip attachment portion. The grip insert may further comprise at least one threaded bore configured to receive an adjustment fastener, wherein turning the adjustment fastener pulls the grip insert tight to a datum surface of the grip attachment portion. The threaded bore may also be forward of nominal position of an adjustment fastener to move the grip insert tight to a datum surface as the fastener is threaded into a bore.

In the bow, a cross-sectional outer perimeter of the grip attachment portion may be greater than a cross-sectional outer perimeter of an assembled grip attachment portion and grip insert. A width of the grip attachment portion may be equal to a width of an assembled grip attachment portion and grip insert. A bending moment of inertia of the grip insert may be less than half of a moment of inertia of the grip attachment portion, and/or a combined bending moment of inertia of the grip attachment portion and the grip insert may be greater than a combined sum of the bending moment of inertia of the grip attachment portion and a bending moment of inertia of the grip insert.

In another embodiment, a method of providing an adjustable hand grip for an archery bow is provided. The method may comprise providing a riser of a bow, the riser having a handle portion having a mating aperture, determining a grip setting to be used with the handle portion, and attaching a modular grip to the handle portion by inserting a mating portion of the modular grip into the mating aperture of the handle portion. An external surface of the modular grip may provide the grip setting upon attachment of the modular grip to the handle portion.

In this method, the handle portion may comprise a longitudinal axis and the grip setting may be a grip angle. The modular grip may have an upper portion and a lower portion having different thicknesses providing the grip angle upon attachment of the modular grip to the handle portion. The modular grip may be removably attached to the handle portion. The grip setting may be a brace height or brace height position of the bow, wherein a thickness of the modular grip provides the brace height or brace height position when the modular grip is attached to the handle portion.

In another aspect, a modular riser assembly for an archery bow is shown and described. The assembly may comprise a riser having upper and lower ends each configured to retain upper and lower bow limbs, with the riser having a handle portion between the upper and lower ends and the handle portion configured to be grasped by an archer. The assembly may also include a first interchangeable grip member and a second interchangeable grip member, wherein the interchangeable grip members each may be removably attachable to the handle portion by insertion of a portion of the grip member into the handle portion and may each provide a different grip angle for the archer upon attachment to the handle portion.

In this modular riser assembly, the first and second interchangeable grip members may each have an upper thickness and a lower thickness, wherein the grip members may each provide a different grip angle based on the upper and lower thicknesses being different. A rear surface of each of the grip members may comprise a continuous slope from the upper portions to the lower portions. The first and second interchangeable grip members may also each further comprise a front surface configured to contact a rear surface of the handle portion upon attachment of the first or second interchangeable grip members to the handle portion. Additionally, the grip members may each have different thicknesses providing different brace height positions for the archery bow.

The above summary of the present invention is not intended to describe each embodiment or every implementation of the present invention. The figures and the detailed description that follow more particularly exemplify a preferred embodiment.

DETAILED DESCRIPTION

Figure 1:
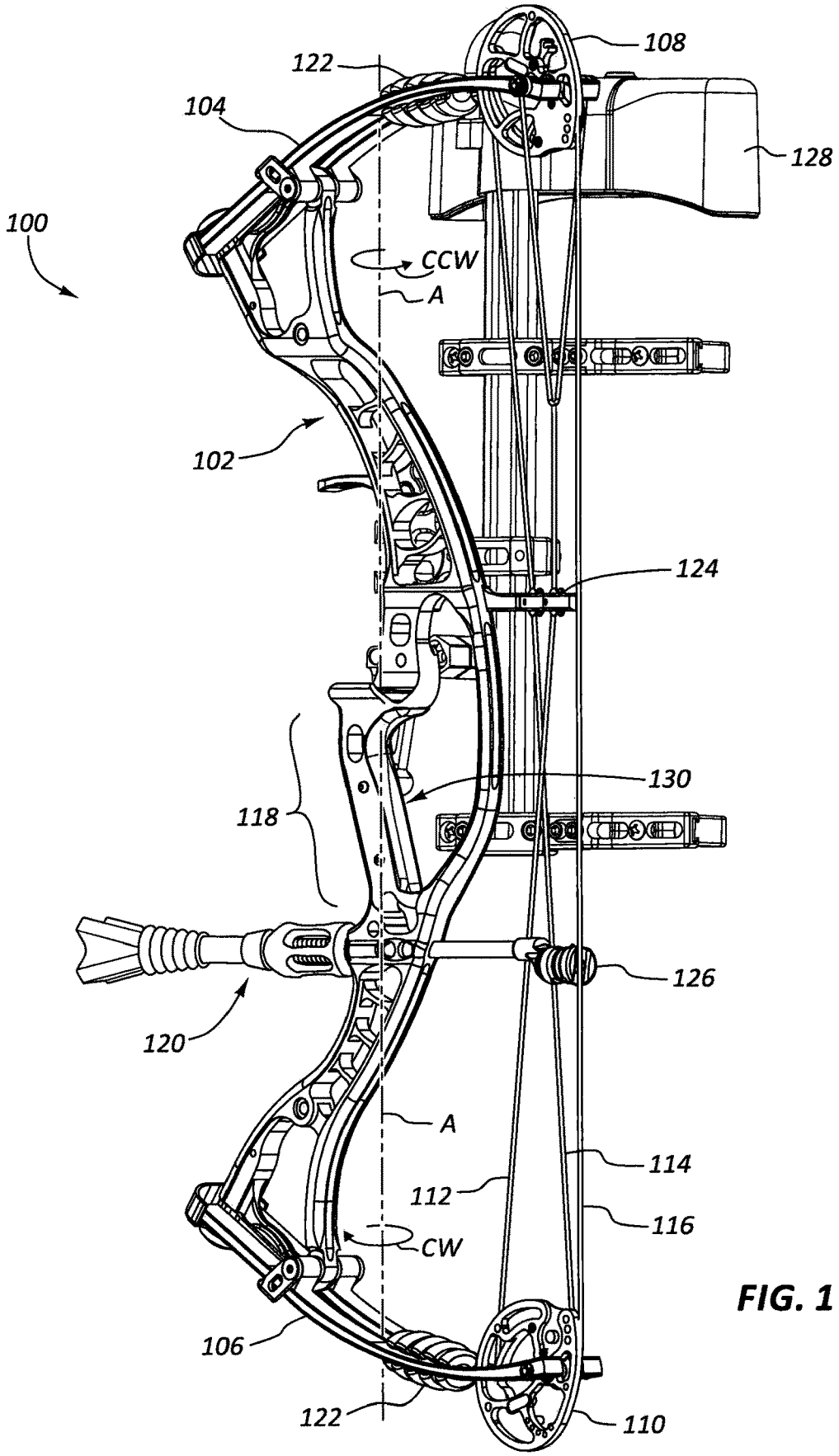
FIG. 1 shows a perspective view of a bow having a modular hand grip insert.

The present disclosure generally relates to adjustable grips and inserts that allow archers to customize and improve the accuracy and feel of their bows. These grips may allow adjustment to draw length, grip angle, grip size, and grip feel while minimizing negative effects on the riser structure. In some embodiments, a handle riser of an archery bow is provided. Material is removed from the rear surface of the riser in order to receive a locating protrusion, flange, or boss extending from the front surface of a grip insert. Mounting the grip in this fashion may remove issues associated with translational and rotational alignment of grips mounted to the outside of the riser. The grip insert may be inserted into the opening in the riser and may be secured to the riser by fasteners, adhesives, or other connection methods.

In some cases, the grip insert may be removably attached to the riser to provide adjustable control over the shape of the grip. For example, in some cases a plurality of grip inserts may be provided that each have a different form, such as each providing a different grip angle, texture, or curvature. By fine tuning the grip angle to desired levels of palm and wrist pressure, the archer may improve accuracy and bow stability. Some arrangements may allow the archer to adjust the left- and right-orientation of the grip insert to adjust how the bow balances or tunes for a specific setup.

Grip assemblies herein may maintain the same feel as a grip designed as part of the riser structure. While conventional grips are limited in size by the amount of material removed on the riser required to mount them, present grip inserts may provide the same feel as thinner and sleeker designs found in risers with self grips while still providing adjustment between different inserts. In some cases, a grip insert may be referred to as a grip member or interchangeable grip member, and a riser handle may be referred to as a grip attachment member.

Many archers require draw length positions that are accurate to 1/32" for proper fit and shot execution. In some cases, adjustment of the limbs or bowstring to change the draw length causes the bow's cams to move out of optimal alignment. The adjustable grip assemblies herein may be used to fine tune draw length without having to change the string and cable lengths of the bow. Thus, in a compound bow, the bow's cams may remain in their optimum performance and tuning position while the archer may still obtain his or her desired draw length.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments. In some cases, the present disclosure may be applicable to compound bows, recurve bows, and traditional bows. As used herein, a bowstring extending between distal ends of bow limbs may extend from a connection of the bowstring to the distal ends themselves, as in a traditional or recurve bow, or from a connection of the bowstring between cams at the distal ends of the limbs, as in a compound bow.

Turning now to the figures in detail, FIG. 1 shows an example archery bow 100. The archery bow 100 includes a riser 102 (i.e., handle riser), first and second limbs 104, 106 (i.e., upper and lower limbs) mounted to the riser 102, and first and second cams 108, 110 (i.e., upper and lower cams) supported on the first and second limbs 104, 106, respectively. A pair of cables 112, 114 and a bowstring 116 extend between the first and second cams 108, 110. The archery bow 100 is typically operated by a user grasping the riser 102 about a handgrip portion 118 with one hand (e.g., the left hand) and pulling or drawing the bowstring 116 in a rearward direction away from the riser 102 with an opposite hand (e.g., the right hand).

The archery bow 100 may include a number of accessories mounted thereto. For example, the archery bow 100 may include a stabilizer assembly 120, a plurality of dampeners 122, a cable guard 124, a bowstring silencer 126, and a quiver 128. When shooting the bow, bow torque may be applied around an axis A running vertically and centrally through the riser 102 and parallel to bowstring 116. The torque acting on the bow by the archer may cause the bow to rotate clockwise or counterclockwise around vertical axis A, as indicated by the rotation arrows CW, CCW. In the view of FIG. 1, with the archer holding the handgrip portion 118 in his left hand while shooting the bow, the distal ends of the upper limbs 104 may be defined as moving to the left when the torque is clockwise and move to the right when the torque is counterclockwise. When grasping the handgrip portion 118, the archer's hand may induce the torque around axis A due to forces applied between the handgrip portion 118 and the hand when the bowstring 116 is released. A grip insert 130 may be attached to the riser 102 at the handgrip portion 118.

Figure 2:
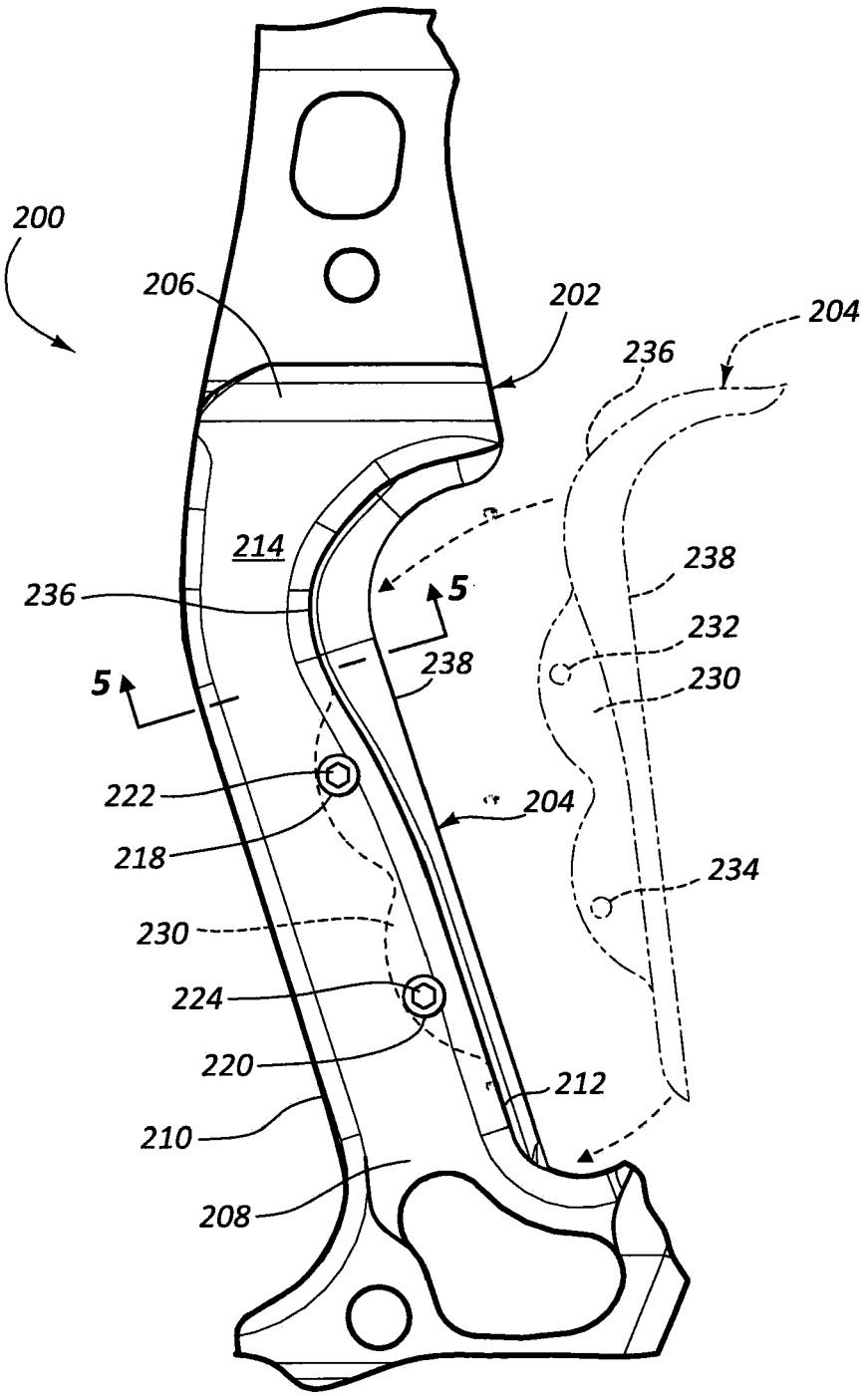
FIG. 2 is a side view of a handle section of a riser having a modular hand grip insert attached.
Figure 3:
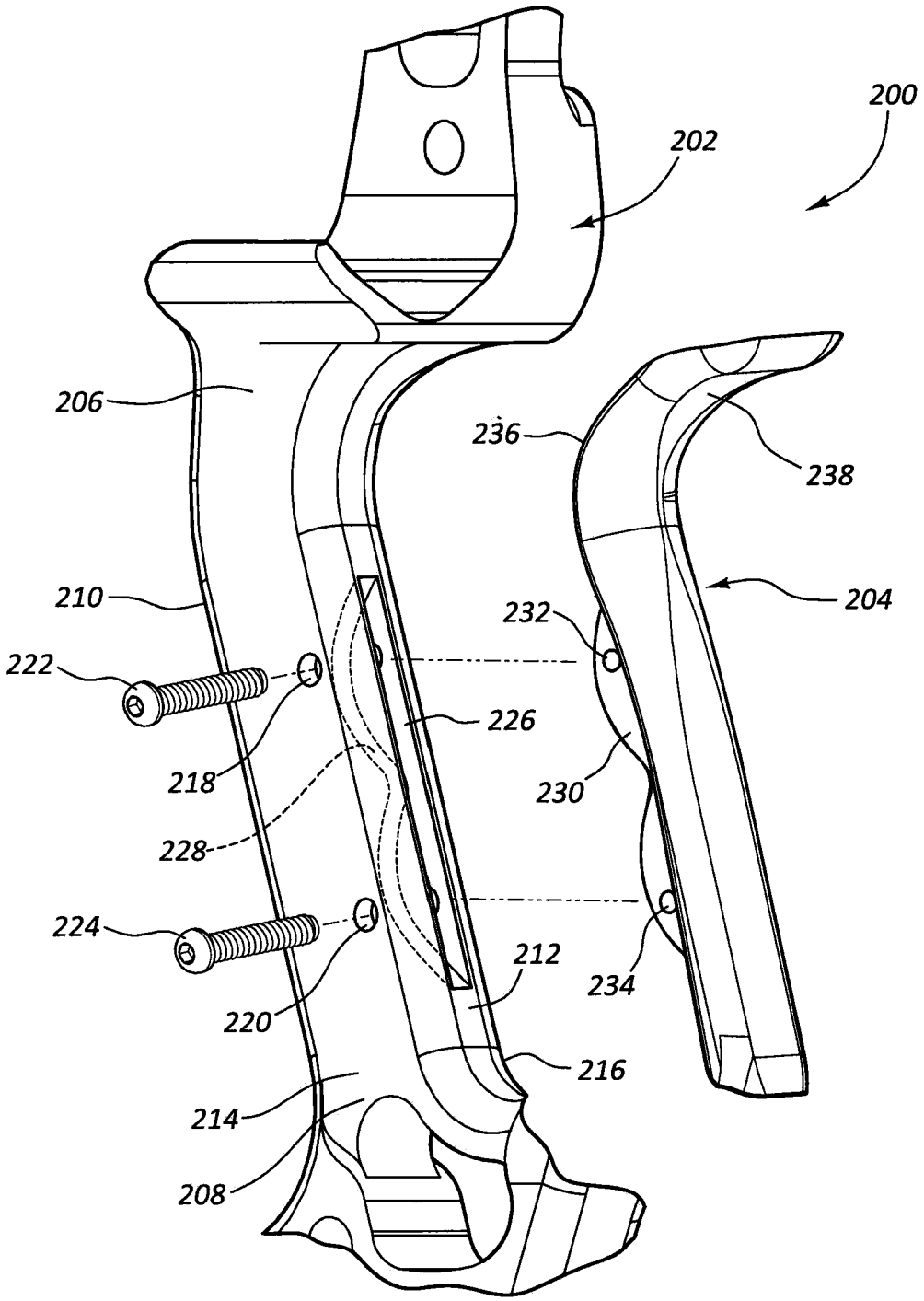
FIG. 3 is an exploded view of a handle section of a riser and modular hand grip insert.

FIGS. 2-3 show a detailed views of a handgrip portion 200 of a riser 202. A grip insert 204 may be attached to the riser 202. The riser 202 may be contoured at the handgrip portion 200 to conform with and be received by a hand of an archer. Thus, an upper end 206 of the handgrip portion 200 of the riser 202 may curve rearward to abut or curve around the web of the archer's hand while grasping the handgrip portion 200. The lower end 208 of the handgrip portion 200 may be less curved and extend downward to help form the grip angle of the handgrip portion 200 in conjunction with the grip insert 204 and to follow the general shape of the palm of the archer's hand.

Figure 5A:
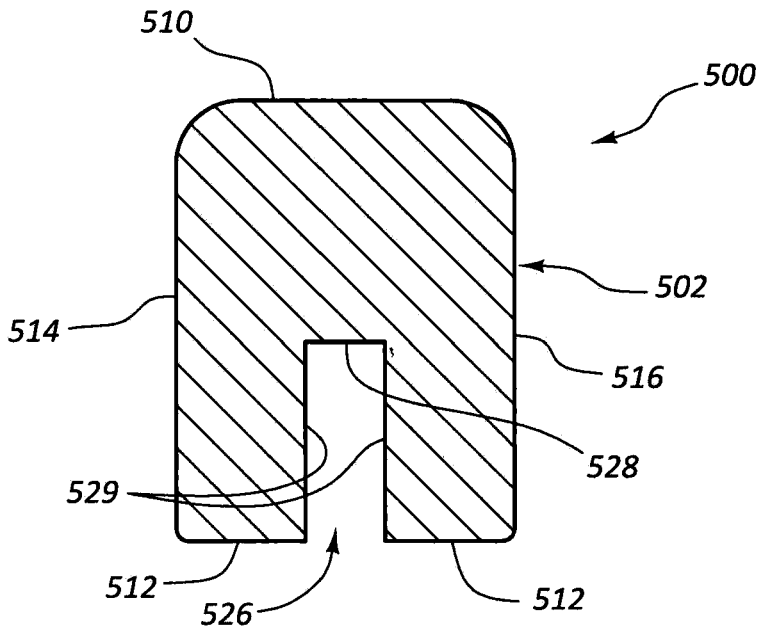
FIG. 5A shows a section view of a riser without a grip insert attached, where the section is taken through lines 5-5 in FIG. 2.

The riser 202 may have a front surface 210, a rear surface 212, and left and right side surfaces 214, 216 (see FIG. 3) forming a generally quadrilateral cross section (see FIG. 5A). The riser may take other shapes, such as generally elliptical, rectangular, circular, pentagonal, or other grip shapes, provided a rear surface 212 is part of the shape. These surfaces 210, 212, 214, 216 may be flat or curved in order to fit into the shape of an archer's hand and to support the grip insert 204. In some embodiments, the rear surface 212 is flattened to improve the fit between the rear surface 212 and an attached grip insert 204.

At least one side surface 214, 216 may comprise bores 218, 220 configured to permit insertion of fasteners 222, 224 into the side surface 214 and/or 216. These bores may be countersunk or beveled to keep fasteners out of the way of the archer's grip. In the pictured embodiment, only the left side surface 214 has bores 218, 220. In some embodiments, there may be more or fewer than two bores 218, 220. For example, the handgrip portion 200 may have no bores, and the grip insert 204 may be retained by an interference fit or press-fit with the riser 202. It may be beneficial for these means for retaining the handgrip portion 200 to allow the grip insert 204 to be withdrawn from the riser 202 and replaced with another grip insert.

The rear surface 212 of the riser 202 may comprise a slot 226. The slot 226 may be referred to as an opening, groove, or aperture configured to mate with the grip insert 204. The slot 226 may be generally vertically oriented relative to the riser 202 and extend along a substantial length of the handgrip portion 200. The slot 226 may extend entirely through the riser 202 as an aperture, but in some cases the slot 226 may only partially extend through the riser 202, as shown in FIG. 3.

The slot 226 may have a seating surface 228 facing rearward within the riser 202. The seating surface 228 may be contoured to receive the grip insert 204 and prevent it from sliding along the rear surface 212 upon attachment to the riser 202. Thus, the shape of the seating surface 228 may correspond with the shape of a protrusion 230 (i.e., flange) extending from the grip insert 204. In some embodiments, the seating surface 228 may be more deeply positioned than the protrusion 230 of the grip insert 204 can normally reach upon insertion of the protrusion 230 into the slot 226. Upon attachment of the fasteners 222, 224, the grip insert 204 may pulled tight to the rear surface 212 of the riser 202. One or more of the bores 218, 220 may also be forward of a nominal position where the protrusion 230 of the grip insert 204 would normally receive the fasteners 222, 224. In this manner, attachment of the fasteners 222, 224 may draw the grip insert 204 tight against the rear surface 212. For example, attaching the fasteners 222, 224 may pull the grip insert 204 into the slot 226 by flexing portions of the grip insert 204.

The protrusion 230 of the grip insert 204 may comprise bores 232, 234. These bores 232, 234 may receive the fasteners 222, 224 when they are inserted through the bores 218, 220 of the riser 202. These bores 232, 234 may therefore correspond in position with the bores 218, 220 of the riser 202 and thereby facilitate securing the grip insert 204 to the riser 202. Fasteners 222, 224 may comprise bolts, nuts, press- or snap-fit connectors, rivets, or other comparable attachment devices. The fasteners 222, 224 may be threaded. Some or all of the bores 218, 220, 232, 234 may be threaded to receive a threaded fastener 222, 224.

In some embodiments, the slot 226 may be wider than the protrusion 230, thereby allowing the protrusion 230 to translate toward and away from the left and right side surfaces 214, 216 while positioned in the riser 202. This translation may be provided by an adjustment fastener (e.g., one or more of fasteners 222, 224) extending through the grip insert 204 (e.g., through a threaded bore 232, 234), and turning the adjustment fastener to adjust the position of the grip insert laterally (i.e., laterally right and left of the handle) relative to the grip attachment portion of the riser 202. The grip insert 204 may be thus translated by tightening or loosening fasteners 222, 224 in the bores 232, 234 of the protrusion 230. The protrusion 230 may have a threaded bore to allow for compensation of width mismatch, such as mismatch between the widths of the riser 202 and the grip insert 204. By inserting a fastener into the threaded bores 232, 234, the fastener may pull the grip insert 204 tight to a datum surface within the slot 226 (e.g., seating surface 528, sidewall surfaces 529, or rear surface 512 of FIG. 5A).

The grip insert 204 may comprise a front surface 236 and a rear surface 238. In FIG. 2, the grip insert 204 is shown in solid lines attached to the riser 202 (except for the protrusion 230 which can be seen within the riser 202 in dashed lines), and the grip insert 204 is shown in dashed lines separated from the riser 202 to show its profile when it is disconnected from the riser 202. The front surface 236 may be shaped to conform to the rear surface 212 of the riser 202 when the protrusion 230 is inserted into the slot 226. The rear surface 238 may conform to the shape of the archer's hand or to a desired grip angle. The rear surface 238 of the grip insert 204 may extend from the rear surface 212 of the riser 202 to form a grip comparable to a conventional integrated handgrip, yet provides interchangeability when desired.

Figures 4A, 4B, 4C, 4D:
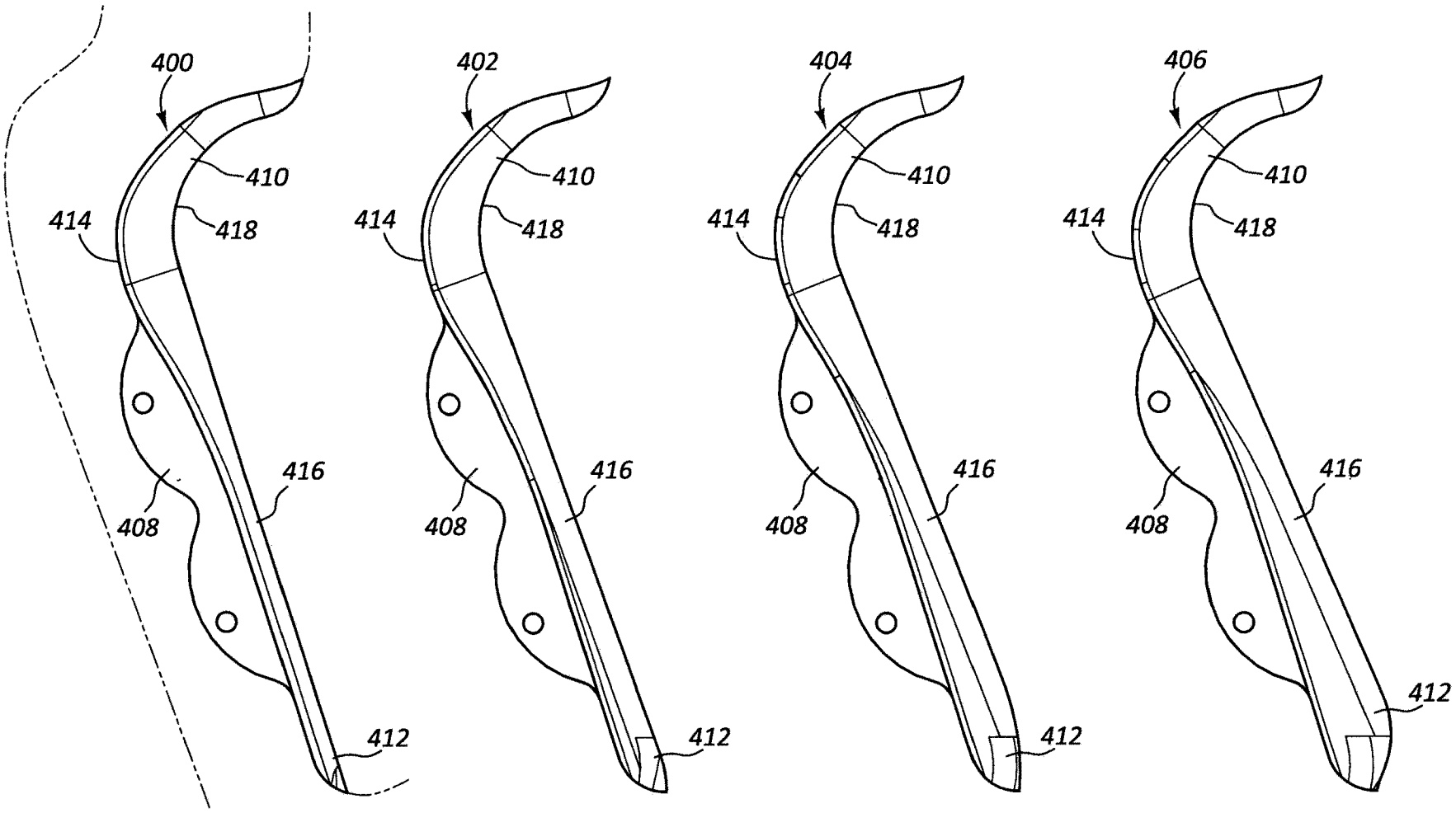
FIG. 4A shows a modular hand grip insert.
FIG. 4B shows another modular hand grip insert.
FIG. 4C shows another modular hand grip insert.
FIG. 4D shows another modular hand grip insert.

FIGS. 4A-4D illustrate how grip inserts 400, 402, 404, 406 may provide various grip angles to a handgrip of a riser. FIG. 4A shows in broken lines where a riser would attach to these grip inserts 400, 402, 404, 406. Although each has a matching flange 408, the thickness and contour of each grip insert 400, 402, 404, 406 may vary for each insert 400, 402, 404, 406. In these examples, each insert 400, 402, 404, 406 has an upper end 410 and a lower end 412. The upper ends 410 have generally equal thicknesses, but the lower ends 412 are different, thereby forming the grip angles of each insert 400, 402, 404, 406. The grip angle in FIG. 4A may be defined as being about 0 degrees, and the grip angles in FIGS. 4B-4D may be about 2 degrees, 4 degrees, and 6 degrees, respectively. In some embodiments, the grip angle may be measured between the rear surface 416 of a grip insert 400, 402, 404, 406 and an axis running parallel to a flat rear surface (e.g., rear surface 212 to the sides of the slot 226) of the riser (e.g., 202) to which a grip insert 400, 402, 404, 406 is attached. The grip angle may also be defined between a general longitudinal axis of the handle riser, a vertical axis (e.g., when shooting the bow), or the bowstring and the rear surface 416. When a bowstring is vertical, the rear surface of a handgrip portion of the riser may be commonly angled at about 17.5 to about 18 degrees, although larger angles are also available. This surface may be used to define an axis that is the zero-degree grip angle when a rear surface of the grip is parallel to this axis.

The front surfaces 414 of each of the grip inserts 400, 402, 404, 406 may be identical so that they will each interface with the same rear surface of a riser. The rear surfaces 416 of each of the grip inserts 400, 402, 404, 406 may have curved or straight portions. The slopes of the rear surfaces 416 may be continuous. The texture of the rear surfaces 416 may have a roughened or smooth texture.

In some embodiments, the grip inserts 400, 402, 404, 406 may have upper ends 410 having varying thicknesses that affect the grip angles of each insert 400, 402, 404, 406. In some cases, the grip inserts 400, 402, 404, 406 may have both increased upper end 410 and lower end 412 thicknesses, which may be useful to modify the brace height of the bow to which they are attached. Thus, the brace height position and grip angle may be adjusted by installing a different grip insert. In some embodiments, the brace height may be defined as the horizontal distance between the front surface of the bowstring and the rear surface 416 of the grip insert 400, 402, 404, 406 at the throat 418. Thus, each grip insert 400, 402, 404, 406 may have different thicknesses at the throat 418 so that the brace height of each insert 400, 402, 404, 406 differs.

The "upper end" may be an upper end portion of the grip inserts 400, 402, 404, 406, and the "lower end" may be a lower end portion of the 400, 402, 404, 406. In some embodiments, the upper ends 410 may be defined as the upper part of the grip insert 400, 402, 404, 406 that contacts the hand of the archer, and the lower ends 412 may be defined as the lower part of the grip insert 400, 402, 404, 406 that contacts the hand of the archer. Thus, the upper end portion and lower end portion may not necessarily be the terminal end portions of the grip insert 400, 402, 404, 406 in all situations. The thickness of the grip insert 400, 402, 404, 406 may be measured horizontally through the grip insert 400, 402, 404, 406 between the rear surface and the front surface of the grip insert 400, 402, 404, 406.

Figure 5B:
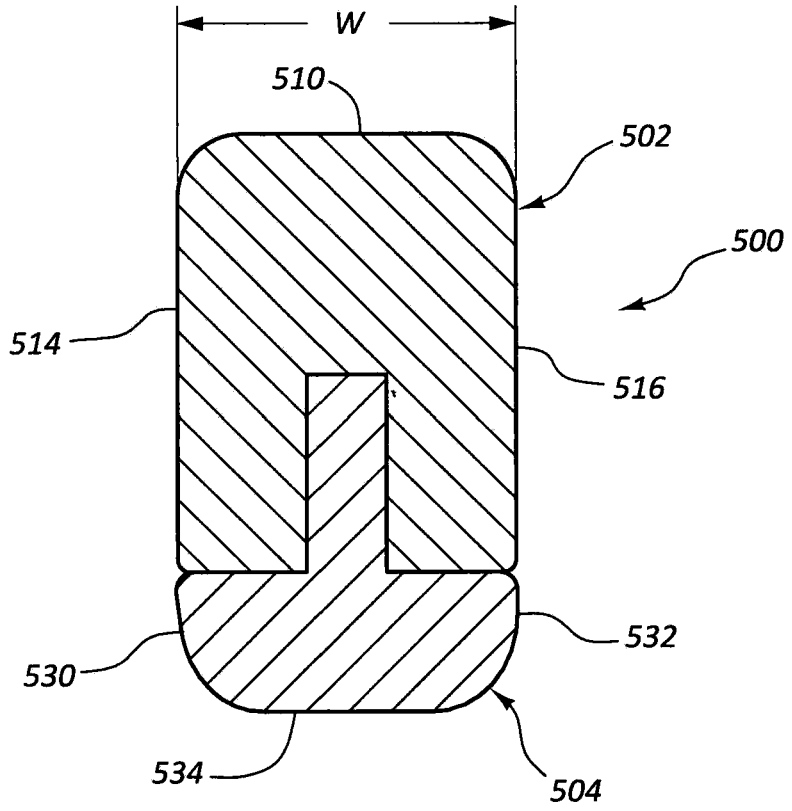
FIG. 5B shows a section view of a riser with a grip insert attached, where the section is taken through lines 5-5 in FIG. 2.

FIG. 5A illustrates a cross-sectional view of a riser 502 of a handgrip portion 500 (e.g., handgrip portion 200 of FIG. 2), and FIG. 5B shows the riser 502 with a grip insert 504 attached. The riser 502 may have a front surface 510, a rear surface 512, a left side surface 514, and a right side surface 516. The rear surface 512 may comprise a slot 526 within which a seating surface 528 is formed. The cross-section of the riser 502 in FIG. 5A may have a riser perimeter running around the outer edge of the cross-section and including inner sidewall surfaces 529 of the slot 526.

The cross section of FIG. 5B shows how a grip insert 504 may be attached within the slot 526 of the riser 502. The grip insert 504 may have a left side surface 530, a right side surface 532, and a rear surface 534. These side surfaces 530, 532 may be shaped to provide a gradual transition between the left side surface 530 of the grip insert 504 and the left side surface 514 of the riser 502 and between the right side surface 532 of the grip insert 504 and the right side surface 516 of the riser 502.

The cross-section of the riser 502 with the grip insert 504 attached may have a combined perimeter running around the front surface 510, left side surfaces 514, 530, rear surface 534, and right side surfaces 516, 532. This combined perimeter may be smaller than the perimeter running around the outer edge of the cross-section of FIG. 5A.

The riser 502 may have a width W that is greater than or equal to the width of a grip insert 504. In this manner, the archer may not induce additional torque due to the grip insert's width being greater than the width of the riser 502. This may be the result of the archer's grip contact being closer to the central vertical longitudinal axis running through the riser 502 in this handgrip portion 500 than in a bow where a conventional grip increases the maximum width to be greater than the width W of the riser 502. The maximum moment of inertia occurs at the widest point of the structural material of the riser, so reducing the maximum width of the riser may reduce moments caused by the width of the handgrip portion of the bow. Using the designs disclosed herein, the bending moment of inertia of the grip insert 504 may be less than one-half the moment of inertia of the riser 502, and the combined moment of inertia may be greater than the sums of the individual sections. Furthermore, because the bending moment of inertia is a function of the distance from neutral axis cubed, the overall length and width of the grip portion of the bow may have a great impact on stiffness and moment of inertia of the bow. Therefore, minimizing the external perimeter contributed by the grip insert 504 may maximize the structural stiffness of the handgrip portion 500.

In these embodiments, the riser 502 has been described as having a slot 526 configured to receive an extension of the grip insert. In other embodiments, the riser 502 may have an extension that is configured to fit within a slot in the grip insert. Thus, similar logical modifications of the elements of the present disclosure that would be known to those having ordinary skill in the art are considered to be part of the present disclosure as well.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. An archery bow having a modular hand grip, the bow comprising:

a riser having an upper end, a lower end, and a grip attachment portion disposed between the upper and lower ends, the grip attachment portion positioned to be held by a hand of an archer, the grip attachment portion having a rear attachment surface, an opening in the rear attachment surface within which a contoured seating surface is formed, the contoured seating surface being rearward-facing;

a grip insert attached to the grip attachment portion, the grip insert having a rear surface configured to contact the hand of the archer, the grip insert having a protrusion, the protrusion having a contoured protrusion surface non-slidably received against the contoured seating surface, the grip insert having a front surface contacting a portion of the rear attachment surface across a contacting width of the rear attachment surface, the grip insert having a maximum outer width, the maximum outer width of the grip insert being less than or equal to the contacting width of the rear attachment surface of the grip attachment portion;

an upper limb and a lower limb, each limb having a proximal end and a distal end, the proximal ends of the upper and lower limbs being connected to the respective upper and lower ends of the riser;

a bowstring extending between the upper and lower limbs.

2. The archery bow of claim 1, wherein the opening comprises an elongated slot, the elongated slot being elongated in a direction extending along the rear attachment surface, and wherein the grip insert comprises an elongated protrusion attachable in the elongated slot.

3. The archery bow of claim 1, wherein a position of the grip insert relative to the grip attachment portion is adjusted by translating the protrusion of the grip insert laterally within the opening.

4. The archery bow of claim 3, further comprising a second grip insert having a different thickness and an installation of the second grip insert adjusts a distance between the front surface relative to the rear surface.

5. The archery bow of claim 3, wherein the grip insert further comprises at least one threaded bore configured to receive an adjustment fastener; wherein turning the adjustment fastener adjusts the position of the grip insert relative to the grip attachment portion by translating the protrusion laterally within the opening and relative to the grip attachment portion.

6. The archery bow of claim 5, wherein the at least one threaded bore is forward relative to the grip attachment portion of the riser.

7. The archery bow of claim 1, wherein the grip attachment portion comprises a grip cross-sectional outer perimeter and wherein the grip attachment portion and the grip insert collectively comprise a combined cross-sectional outer perimeter where the protrusion of the grip insert is received against the contoured seating surface of the grip attachment portion of the riser, the combined cross-sectional outer perimeter extending around a front surface of the riser, left and right outer side surfaces of the grip insert and the riser, and the rear surface of the grip insert, the grip cross-sectional outer perimeter being greater than the combined cross-sectional outer perimeter.

8. The archery bow of claim 1, wherein a bending moment of inertia of the grip insert is less than half of a moment of inertia of the grip attachment portion.

9. The archery bow of claim 8, wherein a combined bending moment of inertia of the grip attachment portion and the grip insert is greater than a sum of the bending moment of inertia of the grip attachment portion and a bending moment of inertia of the grip insert.

10. A method of providing an adjustable hand grip for an archery bow, the method comprising:

providing a riser of a bow, the riser having a handle portion, the handle portion having a mating aperture and a rear surface;

attaching a modular grip to the handle portion by inserting an elongated flange of a mating portion of the modular grip into the mating aperture of the handle portion, the elongated flange having a contoured flange surface corresponding in shape to a rearward-facing contoured aperture surface of the mating aperture, the contoured flange surface being non-slidably received against the contoured aperture surface, the rear surface of the handle portion contacting a front surface of the modular grip across a contacting width, the modular grip having a maximum outer width, the maximum outer width of the modular grip being less than or equal to the contacting width of the rear surface;

positioning the modular grip in a removably fixed grip setting relative to an external surface of the handle portion upon attachment of the modular grip to the handle portion, the mating portion having a front surface configured to contact a rear surface of the handle portion.

11. The method of claim 10, wherein the handle portion comprises a longitudinal axis and the removably fixed grip setting is a grip angle.

12. The method of claim 11, wherein the modular grip has an upper portion and a lower portion having different thicknesses providing the grip angle upon attachment of the modular grip to the handle portion.

13. The method of claim 10, wherein the modular grip is removably attached to the handle portion.

14. The method of claim 10, wherein the removably fixed grip setting is a brace height position of the bow, wherein a thickness of the modular grip provides the brace height position when the modular grip is attached to the handle portion.

15. A modular riser assembly for an archery bow, the assembly comprising:

a riser having upper and lower ends configured to retain upper and lower bow limbs, the riser having a handle portion between the upper and lower ends, the handle portion configured to be grasped by an archer, the handle portion having a rear surface and an opening;

a first interchangeable grip insert member and a second interchangeable grip insert member, the first and second interchangeable grip insert members each being removably attachable to the handle portion by insertion of an elongated flange portion of the first or second interchangeable grip insert member, which corresponds in shape to the opening, into the opening of the handle portion and each providing a different grip angle for the archer upon attachment to the handle portion;

wherein the first and second interchangeable grip members each have an upper thickness and a lower thickness, wherein the first and second interchangeable grip members each provide the different grip angle based on the upper and lower thicknesses being different;

wherein the first interchangeable grip insert member and the second interchangeable grip insert member each comprise a front surface configured to contact the rear surface of the handle portion across a contact width of the rear surface upon attachment of the first interchangeable grip insert member or the second interchangeable grip member to the handle portion, and a maximum outer width of the first and second interchangeable grip insert members is less than or equal to the contact width of the rear surface of the handle portion, the elongated flange portion configured to simultaneously contact the rear surface of the handle portion above a vertical center point of the handle portion and below the vertical center point of the handle portion;

wherein the first and second interchangeable grip insert members are configured to be attached to the handle portion using at least one fastener oriented transverse to the elongated flange portion.

16. The modular riser assembly of claim 15, wherein a rear surface of each of the grip insert members comprises a continuous slope from upper portions to lower portions.

17. The modular riser assembly of claim 15, wherein the grip insert members each have different thicknesses providing different brace height positions for the archery bow.

* * * * *